US007392792B2

(12) United States Patent
Puckett

(10) Patent No.: US 7,392,792 B2
(45) Date of Patent: Jul. 1, 2008

(54) SYSTEM FOR DYNAMICALLY DETECTING FUEL LEAKAGE

(75) Inventor: Daniel Reese Puckett, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/506,912

(22) Filed: Aug. 21, 2006

(65) Prior Publication Data

US 2008/0041331 A1 Feb. 21, 2008

(51) Int. Cl.
*F02M 69/46* (2006.01)
*F02B 77/08* (2006.01)

(52) U.S. Cl. ..... 123/456; 123/198 D

(58) Field of Classification Search ..... 123/456, 123/198 D, 295; 73/119 A, 115, 40, 49.1
See application file for complete search history.

(56) References Cited

U.S. PATENT DOCUMENTS

| | | | | |
|---|---|---|---|---|
| 5,633,458 | A * | 5/1997 | Pauli et al. | 73/119 A |
| 5,708,202 | A | 1/1998 | Augustin et al. | |
| 5,715,786 | A * | 2/1998 | Seiberth | 123/198 D |
| 2006/0054149 | A1 * | 3/2006 | Uchiyama | 123/676 |
| 2007/0079792 | A1 * | 4/2007 | Dingler et al. | 123/198 D |

FOREIGN PATENT DOCUMENTS

| | | |
|---|---|---|
| DE | 196 22 757 | 5/1997 |
| DE | 199 28 548 | 1/2001 |
| DE | 100 61 855 | 8/2002 |
| GB | 2 310 458 A | 8/1997 |

OTHER PUBLICATIONS

PCT International Search Report; Applicant's File Ref.: 06-534; PCT/US2007/016474; Filing Date: Jul. 20, 2007; Applicant: Caterpillar Inc.

* cited by examiner

*Primary Examiner*—Mahmoud Gimie
(74) *Attorney, Agent, or Firm*—Finnegan, Henderson, Farabow, Garrett & Dunner

(57) ABSTRACT

A fuel control system for an engine is disclosed. The fuel control system may have a source of pressurized fuel and at least one injector configured to receive and inject the pressurized fuel. The fuel system may also have a sensor configured to generate a signal indicative of an actual fuel pressure at the at least one injector, and a controller in communication with the sensor. The controller may be configured to determine a desired fuel pressure at the at least one injector, and compare the signal to the desired fuel pressure. The controller may also be configured to initiate a leak detection sequence in response to the comparison.

20 Claims, 3 Drawing Sheets

SYSTEM FOR DYNAMICALLY DETECTING FUEL LEAKAGE

TECHNICAL FIELD

The present disclosure is directed to a fuel leak detection system and, more particularly, to a system capable of dynamically detecting fuel leakage.

BACKGROUND

Fuel systems often include a source of pressurized fuel, one or more fuel injectors, and a distribution system for directing the pressurized fuel from the source to the fuel injectors. The fuel injectors are typically associated with an engine and it can be important for proper operation of the engine to monitor and adjust various parameters of the fuel system during operation of the engine. For example, over time, the different components of the fuel system may wear causing efficiency losses and/or gradual deviations from desired operating pressures. If these losses and pressure deviations are left unchecked, the performance of the engine may deteriorate. In addition, if the wear is excessive or damage to the system occurs, external fuel leakage and extreme system pressure drop may be possible.

However, if the efficiency losses and pressure deviations can be monitored, corrective and/or precautionary actions may be timely implemented. One example of monitoring fuel system operation and detecting fuel leakage is described in U.S. Pat. No. 5,708,202 (the '202 patent) issued to Augustin et al. on Jan. 13, 1988. Specifically, the '202 patent discloses a method of recognizing fuel leakage from the fuel injection system of an internal combustion engine. The method includes sensing a pressure of the fuel injection system during non-injection events, and comparing the sensed pressures. If a significant deviation in the sensed pressures occur, then leakage is determined. When determining large leaks between the pump and injectors of large flow systems, the non-injection events correspond with the time between the end of one injection and the start of another injection. When determining leaks between the pump and the injectors in small flow systems, the non-injection events must be created by eliminating at least one fuel delivery and at least one fuel injection step. If no leaks are detected between the pump and the injectors, other portions of the system can be leak tested only during a "driven operation" by comparing the pressures sensed when the injectors and the pump of the system are turned off.

Although the method of the '202 patent may sufficiently detect fuel system leaks, it may be limited and intrusive. In particular, the leak testing described in the '202 patent can only be performed during certain engine operations (e.g., when the engine is driven). This limited applicability may be problematic in some situations where continuous leak detection is critical. In addition, because leak testing within the fuel system of the '202 patent, other than between the pump and the injectors, requires the injectors and the pump to be turned off, engine operation may be undesirably interrupted. Further, the method of the '202 patent provides no way to determine if a low pressure event is due to leakage, periodic intentional pressure relieving, or normal wear, and no way to accommodate normal wear.

The control system of the present disclosure solves one or more of the problems set forth above.

SUMMARY OF THE INVENTION

One aspect of the present disclosure is directed to a fuel control system. The fuel control system may include a source of pressurized fuel and at least one injector configured to receive and inject the pressurized fuel. The fuel system may also include a sensor configured to generate a signal indicative of an actual fuel pressure at the at least one injector, and a controller in communication with the sensor. The controller may be configured to determine a desired fuel pressure at the at least one injector, and compare the signal to the desired fuel pressure. The controller may also be configured to initiate a leak detection sequence in response to the comparison.

Another aspect of the present disclosure is directed to a method of detecting leaks within a fuel system. The method may include pressurizing fuel and sensing a pressure of the fuel. The method may also include determining a desired pressure of the fuel, and comparing the sensed pressure and the desired pressure to determine a required pressurizing adjustment. The method may further include comparing the required pressurizing adjustment to a historical adjustment, and implementing the required pressurizing adjustment only if the required pressurizing adjustment is within a predetermined amount of the historical adjustment.

DETAILED DESCRIPTION

Figure 1:
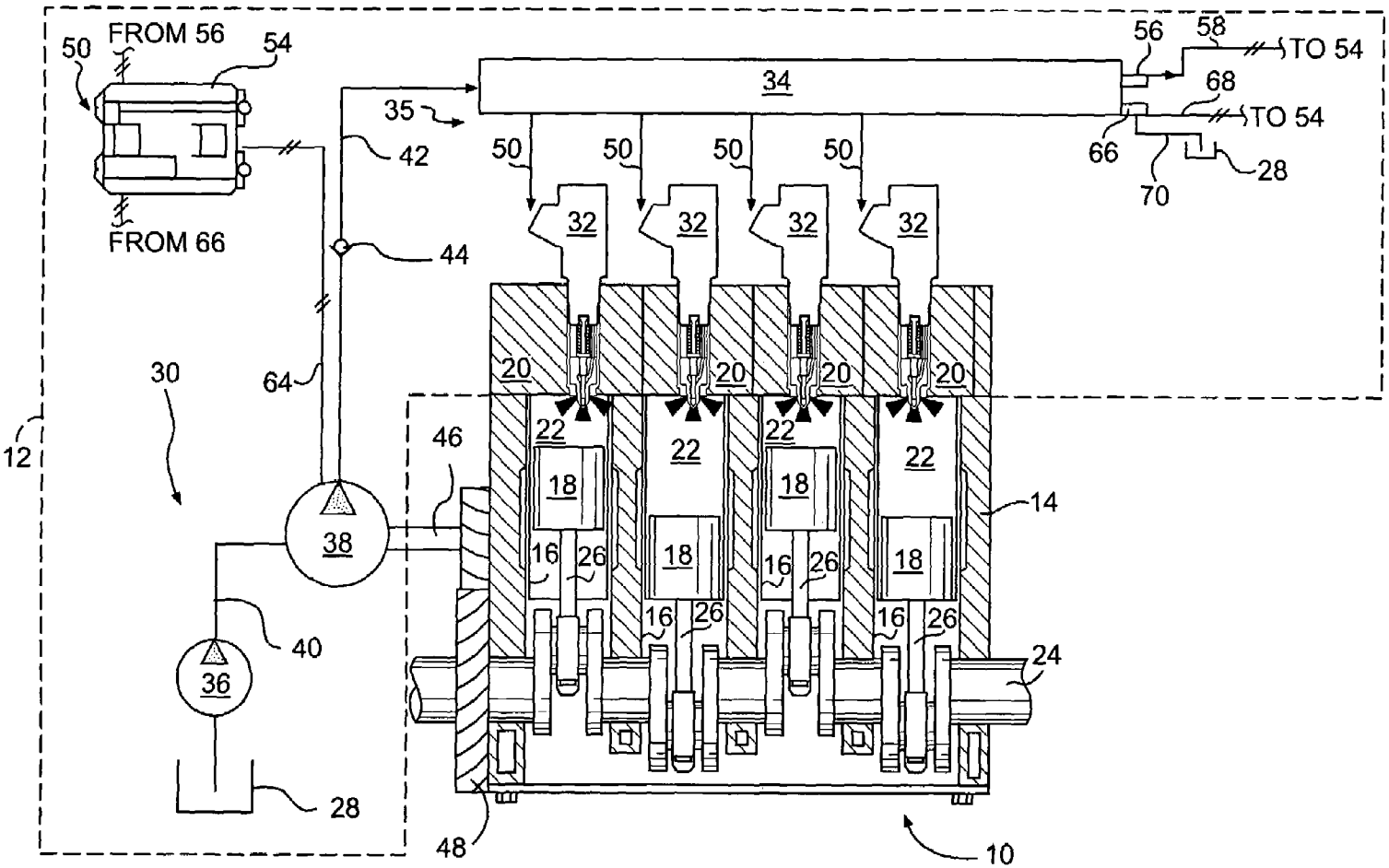
FIG. 1 is a schematic and diagrammatic illustration of an exemplary disclosed engine system.

FIG. 1 illustrates an engine 10 and an exemplary embodiment of a fuel system 12. For the purposes of this disclosure, engine 10 is depicted and described as a four-stroke diesel engine. One skilled in the art will recognize, however, that engine 10 may be any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, a fuel pumping arrangement 30 configured to pressurize the fuel and direct the pressurized fuel to a plurality of fuel injectors 32 by way of a common rail 34.

Fuel pumping arrangement 30 may include one or more pumping devices that function to increase the pressure of the fuel and direct one or more pressurized streams of fuel to common rail 34. In one example, fuel pumping arrangement 30 includes a low pressure source 36 and a high pressure source 38 disposed in series and fluidly connected by way of a fuel line 40. Low pressure source 36 may be a transfer pump configured to provide low pressure feed to high pressure source 38. High pressure source 38 may be configured to receive the low pressure feed and to increase the pressure of the fuel to the range of about 30-300 MPa. High pressure source 38 may be connected to common rail 34 by way of a fuel line 42. A check valve 44 may be disposed within fuel line 42 to provide for one-directional flow of fuel from fuel pumping arrangement 30 to common rail 34.

One or both of low pressure and high pressure sources 36, 38 may be operably connected to engine 10 and driven by crankshaft 24. Low and/or high pressure sources 36, 38 may be connected with crankshaft 24 in any manner readily apparent to one skilled in the art where a rotation of crankshaft 24 will result in a corresponding rotation of a pump drive shaft. For example, a pump driveshaft 46 of high pressure source 38 is shown in FIG. 1 as being connected to crankshaft 24 through a gear train 48. It is contemplated, however, that one or both of low and high pressure sources 36, 38 may alternatively be driven electrically, hydraulically, pneumatically, or in any other appropriate manner.

Fuel injectors 32 may be disposed within cylinder heads 20 and connected to common rail 34 by way of a plurality of fuel lines 50. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration.

A control system 52 may be associated with fuel system 12 to monitor and control the operations of fuel pumping arrangement 30 and fuel injectors 32. In particular, control system 52 may include a controller 54 in communication with a pressure sensor 56 via a communication line 58, with high pressure source 38 via a communication line 64, and with a pressure relief valve 66 via a communication line 68. It is contemplated that controller 54 may be in further communication with each fuel injector 32, low pressure source 36, and/or additional or alternative components of fuel system 12 to monitor and/or control the operations thereof, if desired.

Controller 54 may embody a single microprocessor or multiple microprocessors that include a means for controlling an operation of fuel system 12. Numerous commercially available microprocessors can be configured to perform the functions of controller 54. It should be appreciated that controller 54 could readily embody a general engine microprocessor capable of controlling numerous engine functions. Controller 54 may include a memory, a secondary storage device, a processor, and other components for running an application. Various other circuits may be associated with controller 54 such as power supply circuitry, signal conditioning circuitry, solenoid driver circuitry, and other types of circuitry.

Sensor 56 may embody a pressure sensor configured to sense a pressure of the fuel within common rail 34. Because of the location of sensor 56 proximal the end fuel injector 32 (with respect to FIG. 1, viewing left to right), the pressure sensed by sensor 56 may be indicative of the pressure at the last fuel injector 32. Sensor 56 may generate a signal indicative of this pressure and send the signal to controller 54 via communication line 58. It is contemplated that sensor 56 may alternatively sense a different or additional parameter of the fuel associated with the fuel at the end fuel injector 32 such as, for example, a temperature, a viscosity, a flow rate, or any other parameter known in the art.

Controller 54 may adjust the operation of high pressure source 38 in response to the signal received from sensor 56. That is, if the pressure of the fuel at the end fuel injector 32 is below a predetermined desired value by a set amount, controller 54 may affect the operation of high pressure source 38 to increase the pressure within common rail 34. The pressure within common rail 34 may be increased, for example, by increasing a displacement of high pressure source 38, by reducing an amount of spilled fuel per plunger stroke of high pressure source 38, or in any other manner. In contrast, if the pressure of the fuel at the end fuel injector 32 is above the predetermined desired value by a set amount, controller 54 may decrease the displacement of high pressure source 38.

Controller 54 may track the adjustments made to high pressure source 38. That is, for a particular set of operating condition, high pressure source 38 should generate a corresponding pressure within common rail 34. However, over time, the components of fuel system 12 may wear, and the pressure resulting from the same particular set of operating conditions may deviate (i.e., decrease). In order to continue supplying the same pressure for the particular set of operating conditions, the displacement of high pressure source 38 must be proportionally adjusted and this adjustment amount may increase as fuel system 12 wears over time. Controller 54 may store in its memory a historical value indicative of the immediate past adjustment amount. Controller 54 may continuously update this historical value, and periodically reset the historical value. It is contemplated that controller 54 may alternatively store in its memory all or any number of past adjustment values, if desired. It is further contemplated that controller 54 may perform calculations on the historical data such as determining a running average, a median value, or other calculation and store these calculations in memory for later comparison purposes.

During the adjustment process of high pressure source 38, controller 54 may determine if the low pressure signal received via sensor 56 is indicative of normal system wear or a system malfunction. That is, it may be possible for a low pressure event to occur as a results of a system abnormality or failure, rather than wear. For example, the low pressure condition may be due to the recent occurrence of an intentional pressure relieving event or leakage.

During the intentional pressure relieving event, pressure relief valve 66 may fluidly connect common rail 34 to tank 28 by way of a fluid passageways 70 to relieve pressure from fuel system 12. In particular, pressure relief valve 66 may include a pilot or solenoid operated valve element that is spring-biased toward a closed or fluid-blocking position and movable toward an open or fluid-passing position in response to a pressure within common rail 34 exceeding a predetermined pressure. The predetermined pressure may be variable, if desired, and set or varied according to one or more machine related conditions. Pressure relief valve 66 may maintain system pressure (e.g., the pressure within fuel system 12) at the predetermined level by remaining in the fluid-blocking position until the pressure of the fluid acting on pressure relief valve 66 exceeds the biasing spring force and/or the solenoid (not shown) is energized, while simultaneously protecting the system from excessive pressure spikes. Following the opening of pressure relief valve 66 and the draining of fuel from common rail 34, the pressure within common rail 34 may actually overshoot and drop below a desired pressure. This overshooting of the pressure can result in a low pressure event captured by sensor 56. To accommodate this overshoot in the control of fuel system 12, a signal indicative of the opening event may be generated and sent to controller 54 via communication line 68, thereby making controller 54 aware of the event.

Controller 54 may track the occurrence of the pressure relieving event. That is, in response to the signal received from pressure relief valve 66, controller 54 may track the time elapsed following the event until the next pressure relieving event. Upon receiving a new signal from pressure relief valve 66 indicative of a subsequent pressure relieving event, controller 54 may be reset to again track the elapsed time until the next event. This tracked elapsed time may be stored in the memory of controller 54 for later comparison purposes.

When low pressure within fuel system 12 is detected, controller 54 may determine if the low pressure is due to the recent pressure relieving event. In particular, if the monitored pressure within common rail 34 is significantly less that a desired pressure, controller 54 may evaluate the time elapsed since the most recent pressure relieving event. If this evaluation indicates that the time elapsed since the last pressure relieving event is less than a predetermined length of time, the detected low pressure may be considered due to the last pressure relieving event. However, if the comparison indicates that the time elapsed since the last pressure relieving event is greater than the predetermined length of time, the detected low pressure may be considered due to a system malfunction (e.g., wear of or a leak in fuel system 12). In response to this determination, controller 54 may initiate a pump adjustment and leak detection sequence.

Figure 2:
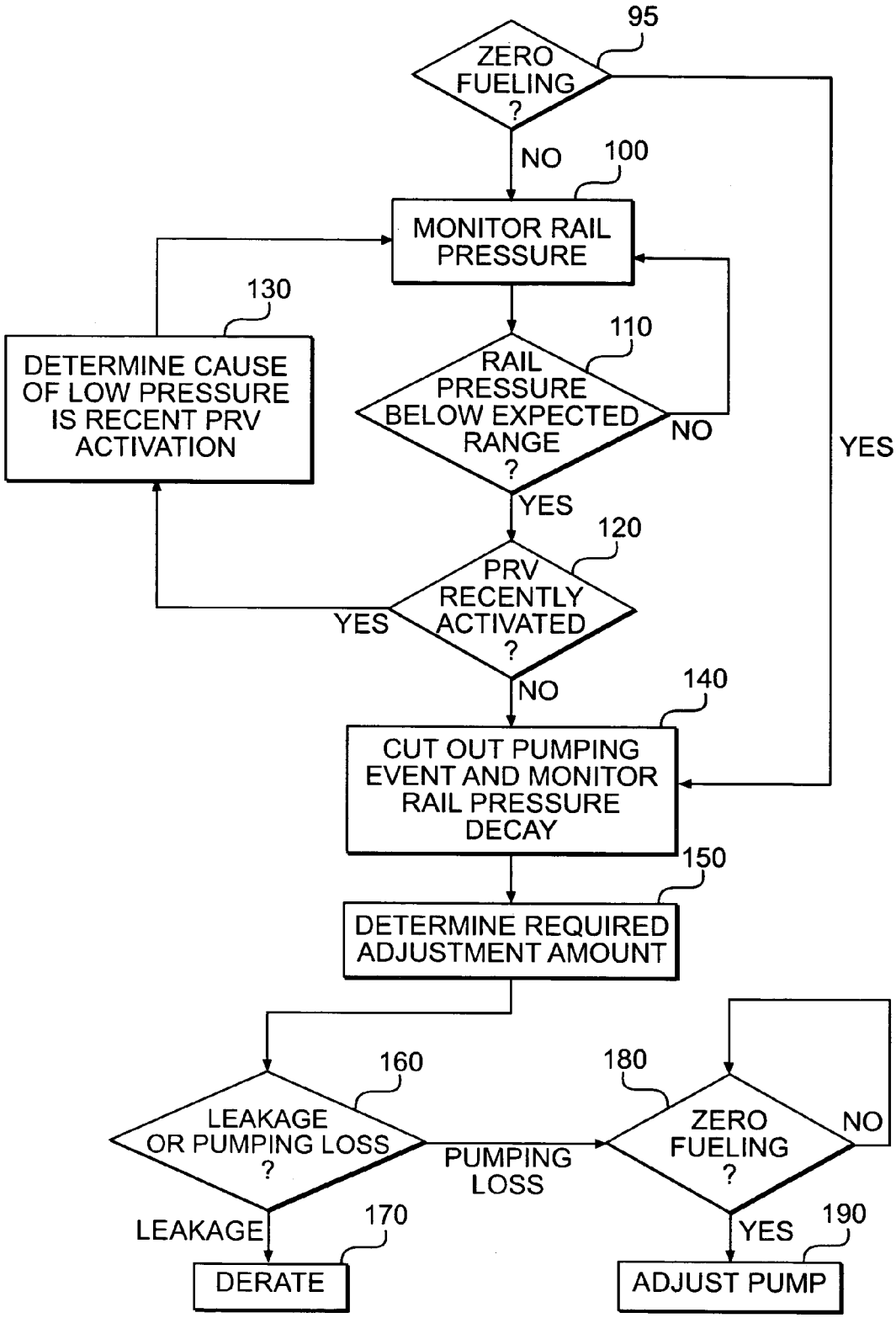
FIG. 2 is a flow chart depicting an exemplary sequence for use in determining the need for adjustment of and fuel leakage within the engine system of FIG. 1.

FIG. 2 is a flow chart depicting an exemplary sequence for use in determining the need for adjustment of fuel system 12 and the existence of a fuel leak. FIG. 2 will be discussed in the following section to further illustrate the disclosed system and its operation.

Figure 3:
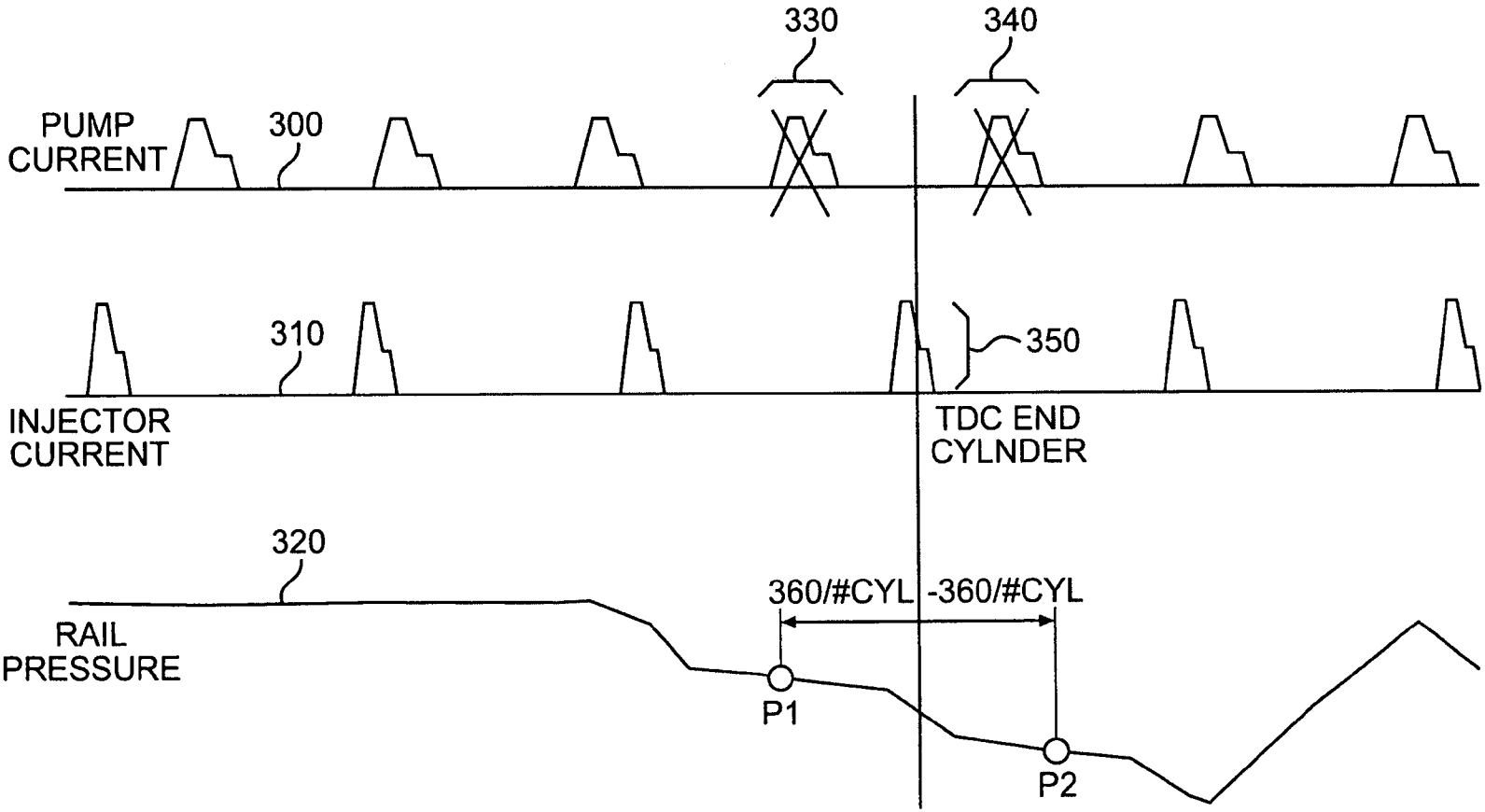
FIG. 3 is a trace chart showing exemplary results of a step within the sequence of FIG. 2.

FIG. 3 is a trace chart showing exemplary results of a step within the sequence of FIG. 2. FIG. 3 will also be discussed in the follow section to further illustrate the disclosed system and its operation.

INDUSTRIAL APPLICABILITY

The fuel injector control system of the present disclosure has wide application in a variety of engine types including, for example, diesel engines, gasoline engines, and gaseous fuel-powered engines. The disclosed fuel control system may be implemented into any engine where continuous leak detection is important, without interruption of the engine. The disclosed fuel system may also prove for adjustment of fuel pressures within the system. The control of fuel system 12 will now be described.

As indicated in FIG. 2, the control of fuel system 12 may begin by determining the existence of a zero fueling event (Step 95). A zero fueling event may include any engine condition where essentially no fuel is injected into combustion chambers 22 of engine 10 such as, for example, when coasting or when engine 10 is shut down. During a zero fueling event, operation of fuel injectors 32 may cease. Controller 54 may determine a zero fueling event by monitoring a current directed to fuel injectors 32 and/or high pressure source 38, by monitoring the position of an acceleration or deceleration pedal (not shown), by monitoring a pressure of fuel system 12, or in any other manner apparent to one skilled in the art.

If the engine is currently fueling (i.e., a zero fueling event is nonexistent), control of fuel system 12 may continue with the monitoring of pressure within common rail 34 (Step 100). Specifically, a parameter indicative of the pressure within common rail 34 may be monitored by sensor 56, sent to controller 54 via communication line 58, quantified, and compared to a desired and expected common rail pressure range (Step 110). This desired and expected common rail pressure range may correspond with a pressure of fuel within common rail 34 required for proper operation of fuel injectors 32 that results in a desired engine output (e.g., speed and/or torque). The monitoring and comparing steps 100, 110 may be performed on a continuous basis.

If the comparison performed in step 110 indicates the pressure of the fuel within common rail 34 is within the desired and expected common rail pressure range, control may return to step 95. However, if the pressure of the fuel within common rail 34 deviates from the desired and expected common rail pressure range, a low pressure diagnostic and leak detection sequence may be initiated. The first step of this sequence may include determining if a pressure relieving event has recently occurred (Step 120). This determination may be made by evaluating the time elapsed since the last pressure relieving event. If the elapsed time is less than a predetermined length of time, the last pressure relieving event may be confirmed as the cause of the low pressure (Step 130), and control may return to Step 100.

However, if the elapsed time is more than the predetermined length of time period, it may be determined that something other than the last pressure relieving event is the cause of the significant adjustment amount. If something other than the last pressure relieving event is the cause of the significant adjustment amount, controller 54 may prepare to quantify the required adjustment. In preparation for the quantifying step, controller 54 may selectively cut out pressurizing strokes of high pressure source 38 that correspond with the actuation of end fuel injector 32, and measure the resulting pressure decay (Step 140).

Step 140 may also immediately follow step 95, if a zero fueling event is detected at step 95. That is, if engine 10 enters a zero fueling event, controller 54 may initiate the adjustment quantifying steps, even if no low pressure events have been previously detected. Step 140 is illustrated in the traces of FIG. 3.

FIG. 3 illustrates two current traces 300,310 and one pressure trace 320. The first current trace 300 may show the current applied to high pressure source 38 over time. Specifically, the first current trace 300 includes eight separate and sequential pumping events. Two of these pumping events labeled as 330 and 340 may be associated with the actuation of the end fuel injector 32, nearest sensor 56. During step 140, each of these pumping events may be cut out, blocked, or otherwise rendered nonexistent. These pumping events may be rendered nonexistent by de-stroking high pressure source 38, spilling any fuel displaced by the plungers of high pressure source 38, or in any other manner known in the art. It is contemplated that the first current trace 300 may alternatively show the amount of fuel displaced during a pumping event, the position of a plunger within high pressure source 38, or any other similar pump-related characteristic.

The second current trace 310 may show the current applied to fuel injectors 32 over time. In particular, the second current trace 310 shows eight injecting events corresponding to the actuation of fuel injectors 32. One of these injecting events labeled as 350 may correspond with the current applied to the end injector 32, nearest sensor 56. As can be determined by a comparison of the first and second current traces, step 140 (referring to FIG. 2) may include cutting out the pumping events immediately before and immediately following the actuation of the end fuel injector 32. It is contemplated that step 140 may include cutting out more than two pumping events, if desired. Further contemplated that the blocked pumping events may be associated with a fuel injector 32 other than the end fuel injector 32, if desired. During a zero fueling event (i.e., when proceeding directly from step 140), although fuel injectors 32 may not be actuating, the pumping events are still cut out to determine rail pressure losses.

The pressure trace 320 shows the decay of common rail 34 that occurs as a result of injection and leakage. Specifically, up until pumping event 330, the pressure of the fuel within common rail 34 may remain substantially constant, with high pressure source 38 supplying the amount of fuel consumed by fuel injectors 32 and leaked from fuel system 12. However, when pumping event 330 is cutout, the supply of fuel from high pressure source 38 is reduced and the pressure of the fuel within common rail 34 may start to drop off as it leaks from fuel system 12 or is injected into combustion chamber 22. As a result, the pressure P1 may be less than the desired pressure of common rail 34, and even less when measured after injecting event 350, at P2. A portion of the difference between the P1 and P2 pressures may be due to the amount of fuel injected during injecting event 350, while the remaining portion may be a result of system leakage or inefficiencies caused by wear.

Controller 54 may quantify the pressure decay of common rail 34 due to system leakage and inefficiencies, and calculate a corresponding adjustment amount required of high pressure source 38 to maintain the desired system pressure (Step 150—referring to FIG. 2). This portion of the pressure decay (e.g., the adjustment amount) may be quantified through the use of conventional calculations based on the difference of the P1 and P2 pressures, a fuel bulk modulus value determined as a function of fuel temperature and pressure, and a high pressure volume. The required adjustment amount may correspond with the amount of displacement/spill change of high pressure source 38 that accounts for both the consumption of fuel injector 32 and the pressure decay associated with leakage or inefficiencies.

Once the required adjustment amount has been calculated, it may be compared to a historical adjustment amount to determine if the required adjustment amount has increased significantly (Step 160). A significant difference between the required adjustment amount and the historical adjustment amount may correspond with a leak, while a minor difference may correspond with pumping losses, inefficiencies, or wear of fuel system 12. If leakage is determined, the operation of fuel system 12 and/or engine 10 may be derated (Step 170), without making the required adjustment or making only limited adjustment to high pressure source 38.

If the required adjustment amount is less than a predetermined amount different from the historical adjustment amount, engine and/or fuel system derate may be blocked, and controller 54 may wait for detection of a zero fueling event (step 180) before making the required adjustment. When a zero fuel event is detected, or still continues following detection of the event in step 95, controller 54 may implement the required adjustment. That is, when fuel injectors 32 are inoperable, the displacement or other parameter of high pressure source 38 may be adjusted such that the resulting pressure within common rail 34 substantially matches a desired system pressure.

The leak protection provided by fuel system 12 may be improved over the prior art. In particular, because the leak detection of fuel system 12 is continuous, any leaks that occur may be immediately recognized and accommodated, instead of waiting for recognition during a "driven" condition. In addition, the leak monitoring of fuel system 12 may be accomplished during any engine operation without significant interruption thereof. In fact, the only interruption of fuel system 12 noticeable by an operator, may be the derate of fuel system 12 and/or engine 10 in response to a recognized and quantified fuel leak. Further, because controller 54 may affect adjustment of high pressure source 38 based on the continuously monitored fuel pressure, the pressure within common rail 34 may be kept substantially stable and within a desired pressure range a greater percent of the time.

In addition, fuel system 12 may be very sensitive to leak detection. That is, because leak detection and pumping loss adjustments are made frequently, the historical adjustment amount stored in the memory of controller 54 and used for comparison may be kept small. This small adjustment amount may allow for the detection of even minor leaks, as the required adjustment amount resulting from a leak would easily exceed the historical amount.

It will be apparent to those skilled in the art that various modifications and variations can be made to the control system of the present disclosure without departing from the scope of the disclosure. Other embodiments will be apparent to those skilled in the art from consideration of the specification and practice of the control system disclosed herein. It is intended that the specification and examples be considered as exemplary only, with a true scope of the disclosure being indicated by the following claims and their equivalents.

What is claimed is:

1. A fuel control system, comprising:

a source of pressurized fuel;

at least one injector configured to receive and inject the pressurized fuel;

a sensor configured to generate a signal indicative of an actual fuel pressure at the at least one injector; and a controller in communication with the sensor, the controller being configured to:

determine a desired fuel pressure at the at least one injector;

compare the signal to the desired fuel pressure; and initiate a leak detection sequence in response to the comparison, wherein the leak detection sequence includes continuing to operate the at least one injector during the leak detection sequence.

2. The fuel control system of claim 1, wherein:

the sensor generates the signal continuously during operation of the fuel system; and the signal is continuously compared to the desired fuel pressure during operation of the fuel system.

3. The fuel control system of claim 1, wherein the controller is further configured to determine a required adjustment of the source that results in the actual fuel pressure substantially matching the desired fuel pressure.

4. The fuel control system of claim 3, wherein the controller is further configured to:

compare the required adjustment to a historical adjustment; and derate operation of the fuel system when the required adjustment is greater than the historical adjustment by a predetermined amount.

5. The fuel control system of claim 4, further including a pressure relief valve configured to relieve the fuel control system of excessive pressures, wherein the controller is configured to track the time elapsed following a pressure relieving event.

6. The fuel control system of claim 5, wherein, if:

the tracked time elapsed is less than a predetermined length of time; and the required adjustment is greater than the historical adjustment by the predetermined amount;

then:

the difference between the actual fuel pressure and the desired fuel pressure is determined to be due to the pressure relieving event; and operation of the fuel system is blocked from derate.

7. The fuel control system of claim 4, wherein the historical adjustment is continuously updated and periodically reset.

8. The fuel control system of claim 4, wherein:

the controller is further configured to implement the required adjustment only if the required adjustment is within the predetermined amount of the historical adjustment; and the required adjustment is only implemented during a zero fueling event.

9. The fuel control system of claim 1, wherein:

the leak detecting sequence includes stopping the source from pressurizing and utilizing the signal to determine pressure decay; and the at least one fuel injector is operational during the leak detection sequence.

10. A method of detecting leaks in a fuel system, the method comprising:

pressurizing fuel;

sensing a pressure of the fuel;

determining a desired pressure of the fuel;

comparing the sensed pressure and the desired pressure to determine a required pressurizing adjustment;

comparing the required pressurizing adjustment to a historical pressurizing adjustment; and implementing the required pressurizing adjustment only if the required pressuring adjustment is within a predetermined amount of the historical pressurizing adjustment.

11. The method of claim 10, wherein sensing includes continuously sensing.

12. The method of claim 10, further including blocking the pressurizing of fuel if the required pressuring adjustment exceeds the historical pressurizing adjustment by the predetermined amount.

13. The method of claim 12, further including:

selectively relieving the pressure of the fuel; and tracking the elapsed time following the selectively relieving, wherein if:

the tracked time elapsed following the selective relieving is less than a predetermined length of time; and the required pressurizing adjustment exceeds the historical pressurizing adjustment by the predetermined amount;

then:

the difference between the sensed pressure and the desired pressure is determined to be due to the selective relieving; and the method further includes limiting the required pressurizing adjustment during implementation.

14. The method of claim 12, further including continuously updating and periodically resetting the historical pressurizing adjustment.

15. The method of claim 10, wherein determining a required pressurizing adjustment includes:

stopping the pressurizing of fuel; and sensing a pressure decay.

16. A power system, comprising:

an engine having at least one combustion chamber;

a source driven by the engine to pressurize fuel;

an injector disposed to inject the pressurized fuel into the at least one combustion chamber;

a pressure relief valve configured to relieve of excessive fuel pressures;

a sensor configured to continuously generate a signal indicative of an actual fuel pressure at the injector; and a controller in communication with the sensor, the controller configured to:

determine a desired fuel pressure at the injector;

compare the signal to the desired fuel pressure to determine a required adjustment of the source; and implement the required adjustment in response to the required adjustment being within a predetermined amount of a historical pressurizing adjustment.

17. The power system of claim 16, wherein:

the controller is further configured to track the time elapsed following a pressure relieving event; and if:

the tracked time elapsed is less than a predetermined length of time; and the required adjustment exceeds the historical pressurizing adjustment by the predetermined amount;

then:

the difference between the actual fuel pressure and the desired fuel pressure is determined to be due to the pressure relieving event; and the required adjustment is limited during implementation.

18. The power system of claim 16, wherein the historical pressurizing adjustment is continuously updated and periodically reset.

19. The power system of claim 16, wherein determining a required adjustment of the source includes stopping the source from pressurizing, and determining pressure decay.

20. The power system of claim 16, wherein the controller is further configured to derate the engine in response to a detected leak.

* * * * *